US010271642B1

(12) United States Patent
Lin

(10) Patent No.: US 10,271,642 B1
(45) Date of Patent: Apr. 30, 2019

(54) DESK WITH COMBINATIVE WORK SURFACES

(71) Applicants: Yi-Chen Tseng, Taichung (TW); HI-MAX INNOVATION CO., LTD., Taichung (TW)

(72) Inventor: Jhih-Fan Lin, Taichung (TW)

(73) Assignees: Yi-Chen Tseng, Taichung (TW); Hi-Max Innovation Co., Ltd., Taichung (TW)

( * ) Notice: Subject to any disclaimer, the term of this patent is extended or adjusted under 35 U.S.C. 154(b) by 0 days.

(21) Appl. No.: 16/109,163

(22) Filed: Aug. 22, 2018

Related U.S. Application Data

(63) Continuation-in-part of application No. 15/906,692, filed on Feb. 27, 2018, now abandoned.

(51) Int. Cl.
*A47B 13/08* (2006.01)
*A47B 13/00* (2006.01)
*A47B 13/02* (2006.01)

(52) U.S. Cl.
CPC ..... *A47B 13/088* (2013.01); *A47B 13/003* (2013.01); *A47B 13/023* (2013.01); *A47B 2013/006* (2013.01)

(58) Field of Classification Search
CPC ..... A47B 87/002; A47B 87/00; A47B 87/001; A47B 9/20; A47B 21/02
USPC ..... 108/64, 147.11, 147, 50.01, 150; 248/159, 161
See application file for complete search history.

(56) References Cited

U.S. PATENT DOCUMENTS 3,082,712 A * 3/1963 Johnson ..... A47B 13/02 108/158.11
3,339,503 A * 9/1967 Flodell ..... A47B 3/00 108/150
3,982,785 A * 9/1976 Ambasz ..... A47C 1/023 297/160
4,679,510 A * 7/1987 Veyhl ..... A47B 17/003 108/109
4,748,913 A * 6/1988 Favaretto ..... A47B 17/00 108/50.02
5,285,987 A * 2/1994 Gonzalez ..... A47F 5/106 248/159
5,522,324 A * 6/1996 van Gelder ..... A47B 21/06 108/50.02
5,794,545 A * 8/1998 McDaniel ..... A47B 87/002 108/64
5,943,966 A * 8/1999 Machado ..... A47B 87/002 108/64
5,967,631 A * 10/1999 Ko ..... A47B 21/00 108/50.01
6,161,487 A * 12/2000 Chang ..... A47B 17/065 108/50.01

(Continued)

*Primary Examiner* — Jose V Chen
(74) *Attorney, Agent, or Firm* — Wang Law Firm, Inc.

(57) ABSTRACT

A desk includes a base and a plurality of work surface assemblies mounted on the base. The base has a shaft and two stand connected to opposite ends of the shaft. Each of the work surface assemblies has a board and a leg having opposite ends connected to the board and the shaft of the base respectively. The shaft has a plurality of shaft sections connected in series. Whereby a user may pick a predetermined number of shaft sections in serial connection according to a number and a pattern of the work surface assemblies to be mounted on the shaft.

7 Claims, 12 Drawing Sheets

(56) References Cited

U.S. PATENT DOCUMENTS

| | | | | |
|---|---|---|---|---|
| 6,267,064 | B1 * | 7/2001 | Ostertag | A47B 13/021 108/108 |
| 6,283,043 | B1 * | 9/2001 | Stern | A47B 13/06 108/50.02 |
| 6,431,319 | B1 | 8/2002 | Myers et al. | |
| 6,662,734 | B2 * | 12/2003 | Chang | A47B 17/065 108/103 |
| 6,997,114 | B2 * | 2/2006 | Chang | A47B 17/06 108/64 |
| 7,908,981 | B2 * | 3/2011 | Agee | A47B 9/04 108/147 |
| D719,386 | S * | 12/2014 | Mueller | D6/709 |
| 8,967,054 | B2 * | 3/2015 | Henriott | A47B 13/06 108/147.19 |
| 9,655,445 | B2 * | 5/2017 | Gammon | A47B 87/002 |
| 2005/0274297 | A1 * | 12/2005 | Montague, III | A47B 87/002 108/64 |
| 2007/0261614 | A1 * | 11/2007 | Weissenrieder | A47B 13/003 108/158.12 |
| 2008/0289545 | A1 * | 11/2008 | Picchio | A47B 9/04 108/106 |
| 2013/0256611 | A1 | 10/2013 | Ruth sen. | |
| 2014/0331903 | A1 * | 11/2014 | Massimini | A47B 13/088 108/64 |
| 2014/0360413 | A1 * | 12/2014 | Schenk | A47B 87/002 108/50.11 |

* cited by examiner

DESK WITH COMBINATIVE WORK SURFACES

BACKGROUND OF THE INVENTION

1. Technical Field

The present invention relates to a desk or a table, and more particularly to a desk with combinative work surfaces.

2. Description of Related Art

Typically, a conventional height adjustable desk has a work surface with a telescopic leg. For example, US 20130256611 and U.S. Pat. No. 6,431,319 provided a height adjustable desk with a scissor for lifting a work surface. U.S. Pat. No. 8,001,909 provided a lifting column for lifting a work surface.

These conventional height adjustable desks only provided a height adjustable work surface. There is no such a prior art, which have plural of adjustable work surfaces to be selected for combination. It may be a solution to have several desks for connection in a matrix. However, it takes a large space for sure. Besides, the complex structure may make it difficult to sit.

BRIEF SUMMARY OF THE INVENTION

In view of the above, the primary objective of the present invention is to provide a desk with combinative work surfaces, which has simple structure and takes less space.

In order to achieve the objective of the present invention, a desk includes a base and a plurality of work surface assemblies mounted on the base. The base has a shaft and two stand connected to opposite ends of the shaft. Each of the work surface assemblies has a board and a leg having opposite ends connected to the board and the shaft of the base respectively. The shaft has a plurality of shaft sections connected in series. Each of the shaft sections has main body, a protrusion at an end of the main body, and a slot at an opposite end of the main body. A diameter of the slot is greater than an outer diameter of the protrusion, whereby the protrusion of the shaft section is able to be inserted into the slot of another one of the shaft sections to connect the shaft sections in series.

Whereby a user may pick a predetermined number of shaft section in serial connection according to a number and a pattern of the work surface assemblies to be mounted on the shaft.

BRIEF DESCRIPTION OF THE SEVERAL VIEWS OF THE DRAWINGS

The present invention will be best understood by referring to the following detailed description of some illustrative embodiments in conjunction with the accompanying drawings, in which.

DETAILED DESCRIPTION OF THE INVENTION

Figure 1:
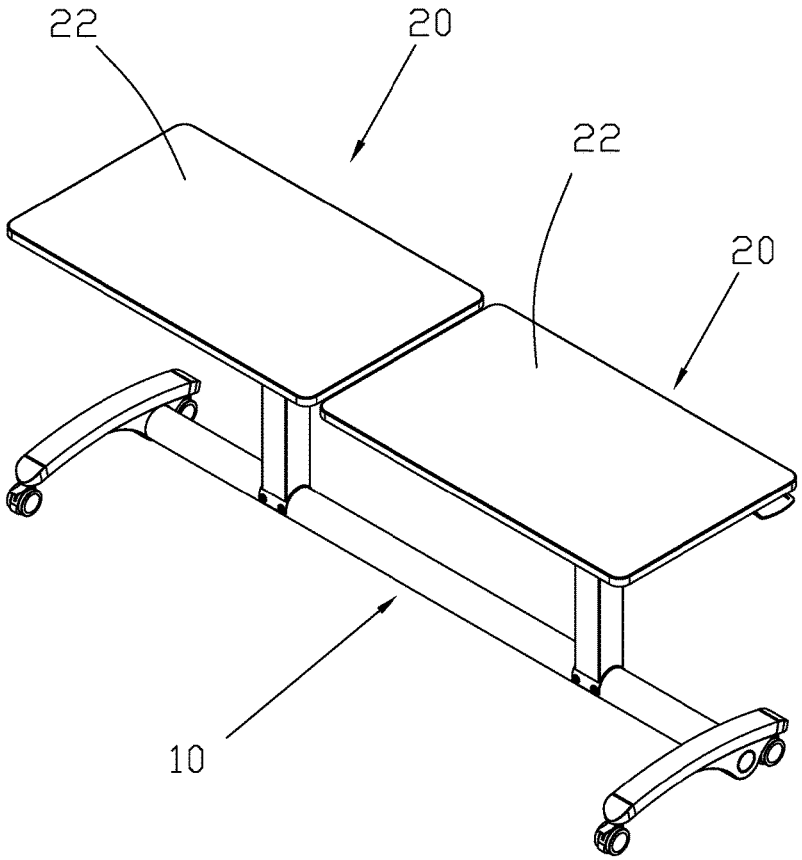
FIG. 1 is a perspective view of a first preferred embodiment of the present invention.
Figure 5:
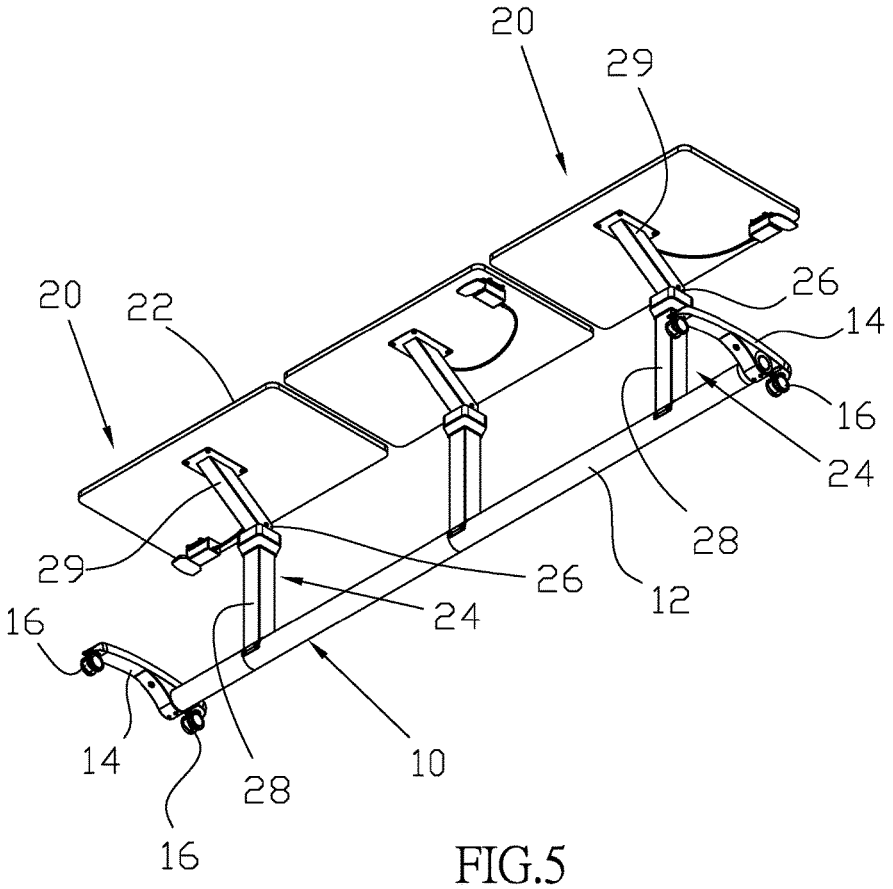
FIG. 5 is another perspective view of the second preferred embodiments of the present invention.
Figure 6:
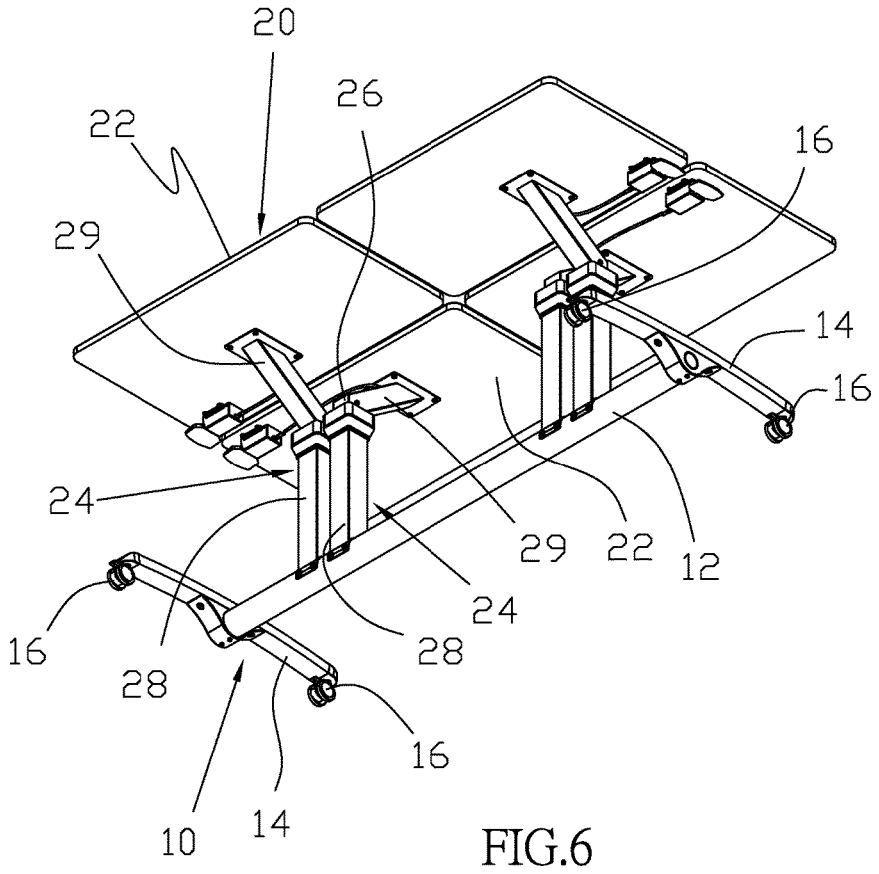
FIG. 6 is another perspective view of the third preferred embodiment of the present invention, showing three work surface assemblies being mounted.
Figure 7:
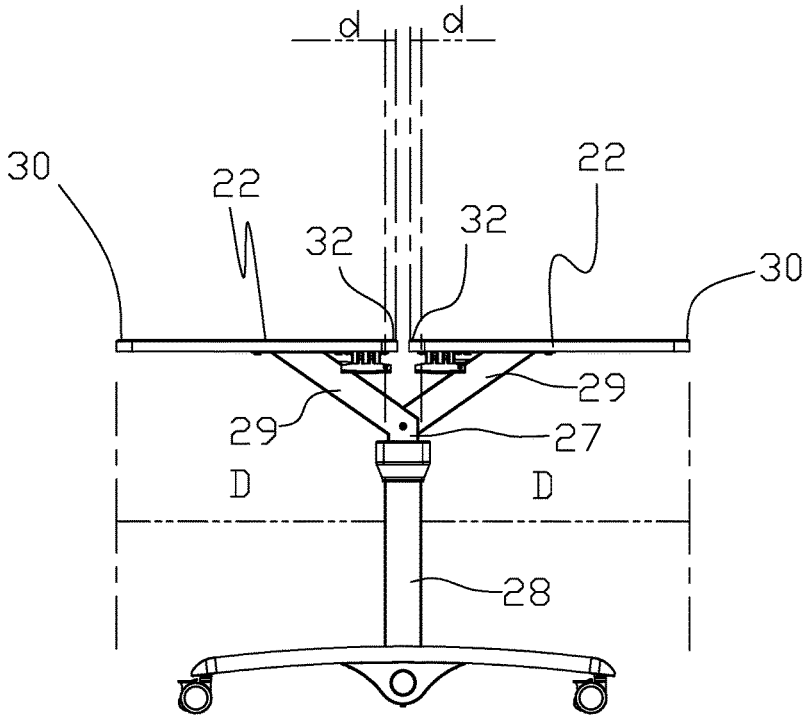
FIG. 7 is a right view of the third preferred embodiment of the present invention.

FIG. 1 shows a desk of the first preferred embodiment of the present invention, includes a base 10 and two work surface assemblies 20. The base 10, referring to FIG. 5 and FIG. 6, includes a shaft 12 and two stands 14 connected to opposite ends of the shaft 12. Each of the stands 14 is provided with two wheels 16. Each of the work surface assembly 20 includes a leg 24 and a board 22 connected to an end of the leg 24. The leg 24 has an opposite end connected to the shaft 12 of the base 10. The leg 24 has an inner tube 26, and the inner tube 26 has an inclined section 29 and a straight section 27 (FIG. 7). The leg 24 further has an outer tube 28, in which the straight section 27 of the inner tube 26 is inserted. The inner tube 26 is controllable to be moved relative to the outer tube 28. The inclined section 29 of the inner tube 26 is left out of the outer tube 28 and connected to a bottom of the board 22. In an embodiment, a pneumatic device (not shown) is mounted in the leg 24, so that the combination of the inner and the outer tubes 26, 28 and the pneumatic device work as a gas spring to lift or lower the board 22. It is noted that the board 22 may be lifted and lowered by manual operation or by electrical control.

Figure 2:
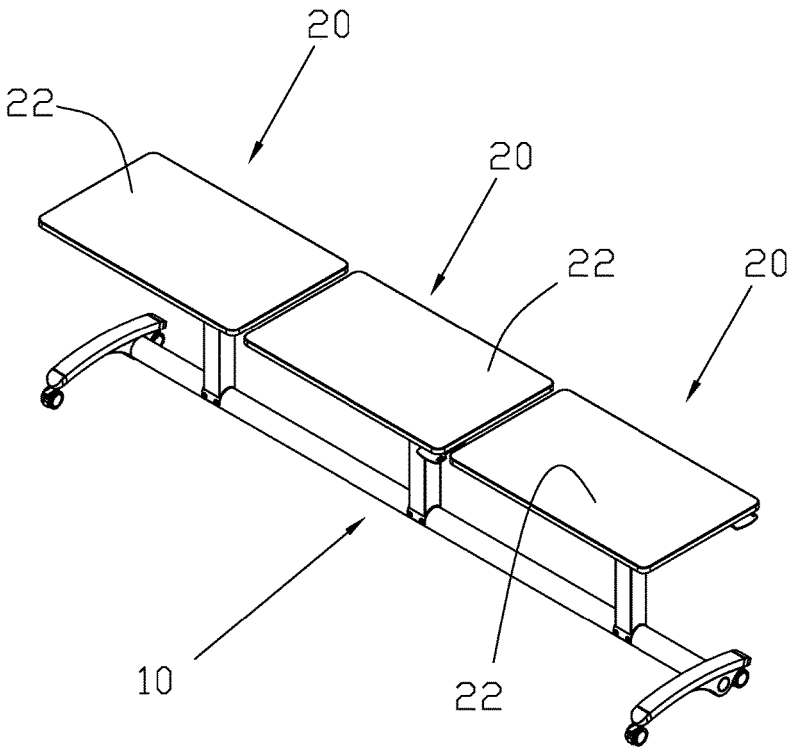
FIG. 2 is a perspective view of a second preferred embodiment of the present invention.
Figure 3:
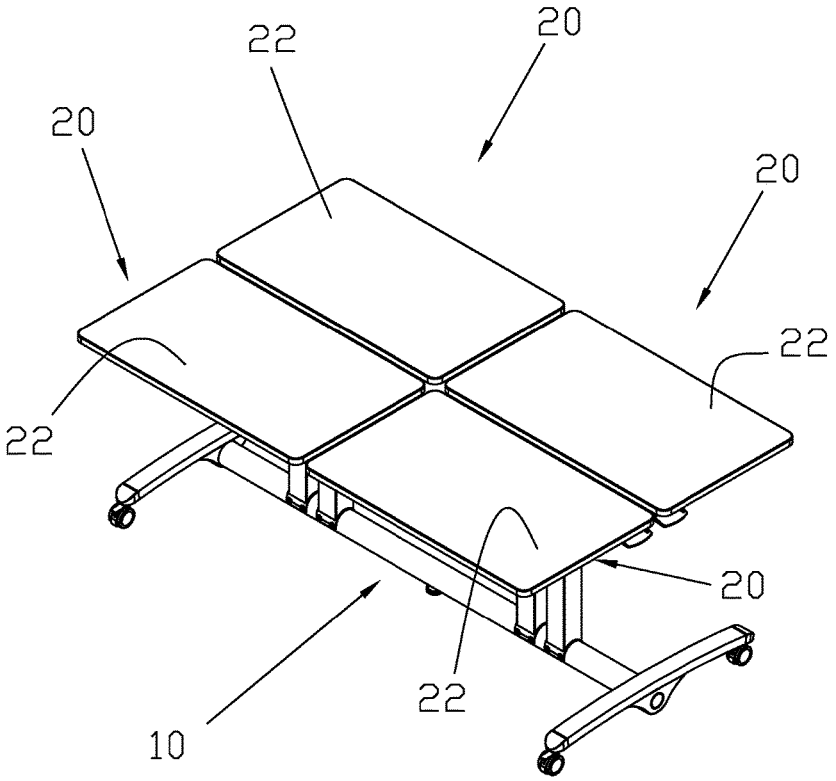
FIG. 3 is a perspective view of a third preferred embodiment of the present invention, showing the work surface being lifted.
Figure 4:
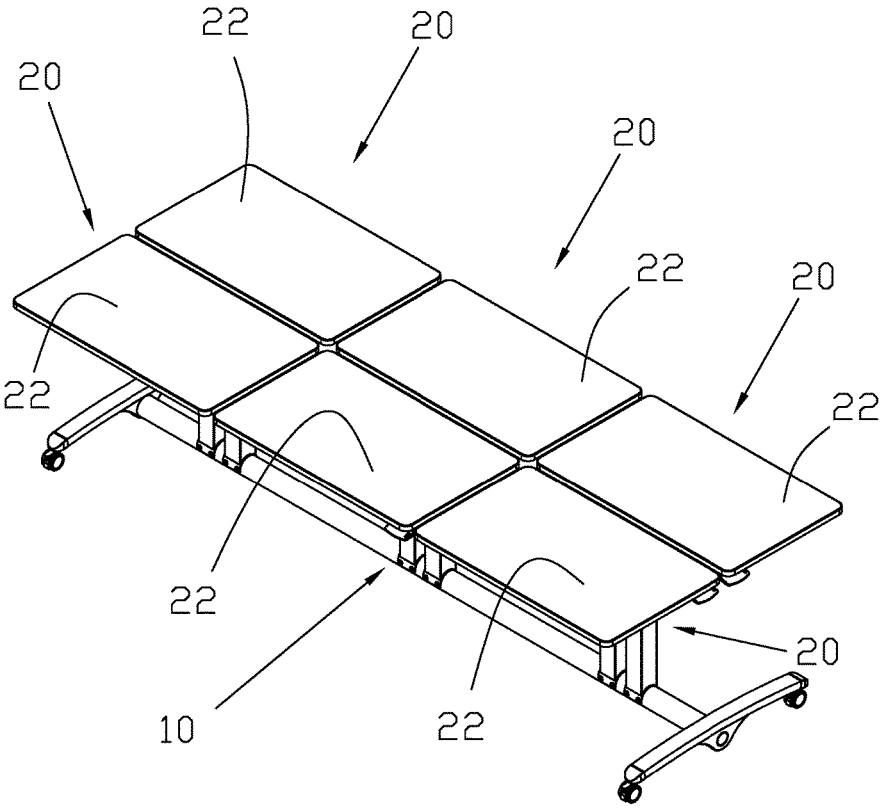
FIG. 4 is a perspective diagram of a fourth preferred embodiment of the present invention.

The same structure may provide the desk of the present invention with more work surface assemblies. For example, FIG. 2 shows the desk of the second preferred embodiment of the present invention having three work surface assemblies 20 arranged in a row. In this matter, the inclined sections 29 of the inner tubes 24 of the work surface assemblies 20 lean toward the same direction (referring to FIG. 5). FIG. 3 shows the desk of the third preferred embodiment of the present invention having four work surface assemblies 20 arranged in two rows. In this matter, the inclined sections 29 of the boards 22 in the same column lean to opposite directions, and the outer tubes 28 arranged in a row (referring to FIG. 6). The same as above, FIG. 4 shows the desk of the fourth preferred embodiment of the present invention having six work surface assemblies 20 arranged in two rows.

Since the shaft 12 is straight, in spite of the boards 22 of the work surface assemblies 20 being arranged in one row or in two rows, the outer tubes 28 (or the straight sections 27) are lined in a row.

As shown in FIG. 7, the board 22 has a first end 30 and a second end 32 opposite to the first end 30. A distance (d) between the second end 32 and the outer tube 28 (or the straight section 27) is greater than a distance (D) between the first end 30 and the outer tube 28 (or the straight section 27).

Figure 8:
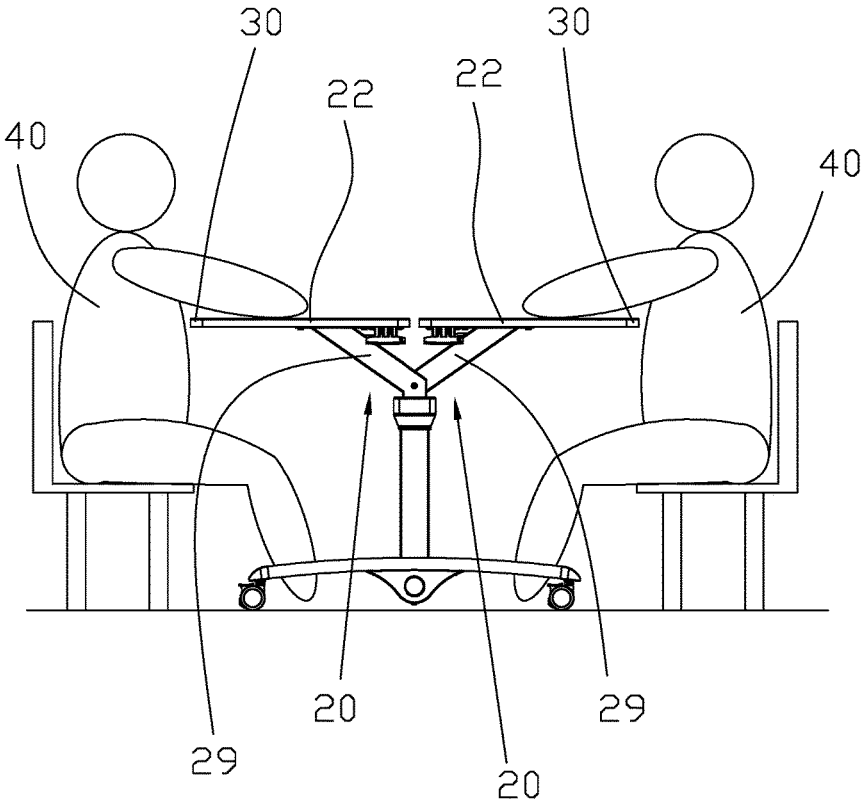
FIG. 8 is a sketch diagram of the preferred embodiment of the present invention, showing users sitting by the desk.

As shown in FIG. 8, the first end 30 is designated to an end proximal to a person who sits by the desk of the present invention. Therefore, the desk of the present invention provides a large space under the board for legs of a person who sits by the desk. In addition, the inclined section 29 of the inner tube 26 is connected to a center of weight of the board, or close to the center of weight which provides the desk with a stable condition.

It is easy to understand that the present invention only provides a base, on which may mount one or more work surface assemblies in in a matrix of a row or two rows. It has a simple structure and takes less space. The height of the board 22 is adjustable to meet a height of a person who sits by the desk.

Figure 9:
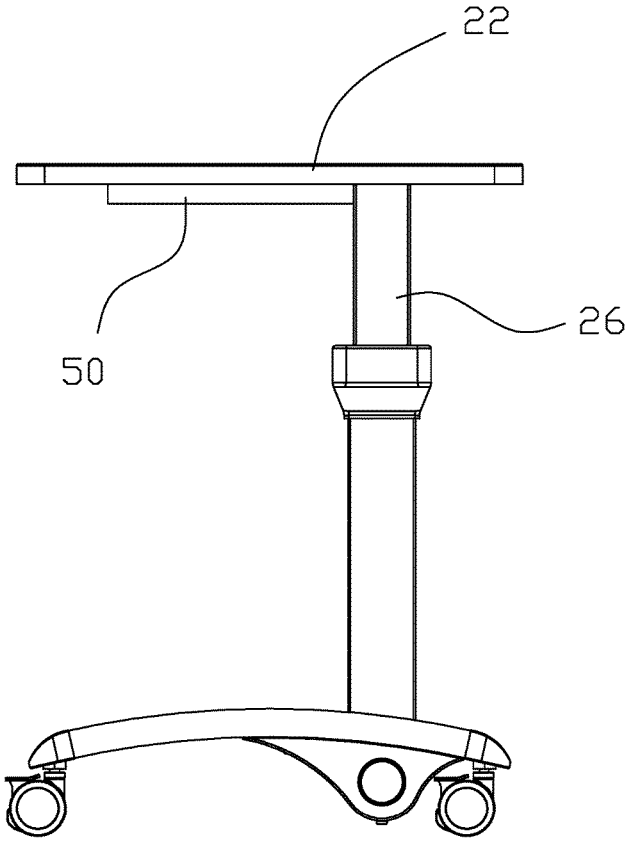
FIG. 9 is a right view of a fifth preferred embodiment of the present invention.

FIG. 9 shows a desk of the fifth preferred embodiment of the present invention, which is similar to above preferred embodiment, except that the leg 26 has a straight section only. In the fifth preferred embodiment, the leg 26 further has a reinforced rib 50 connected to the board 22.

Figure 10:
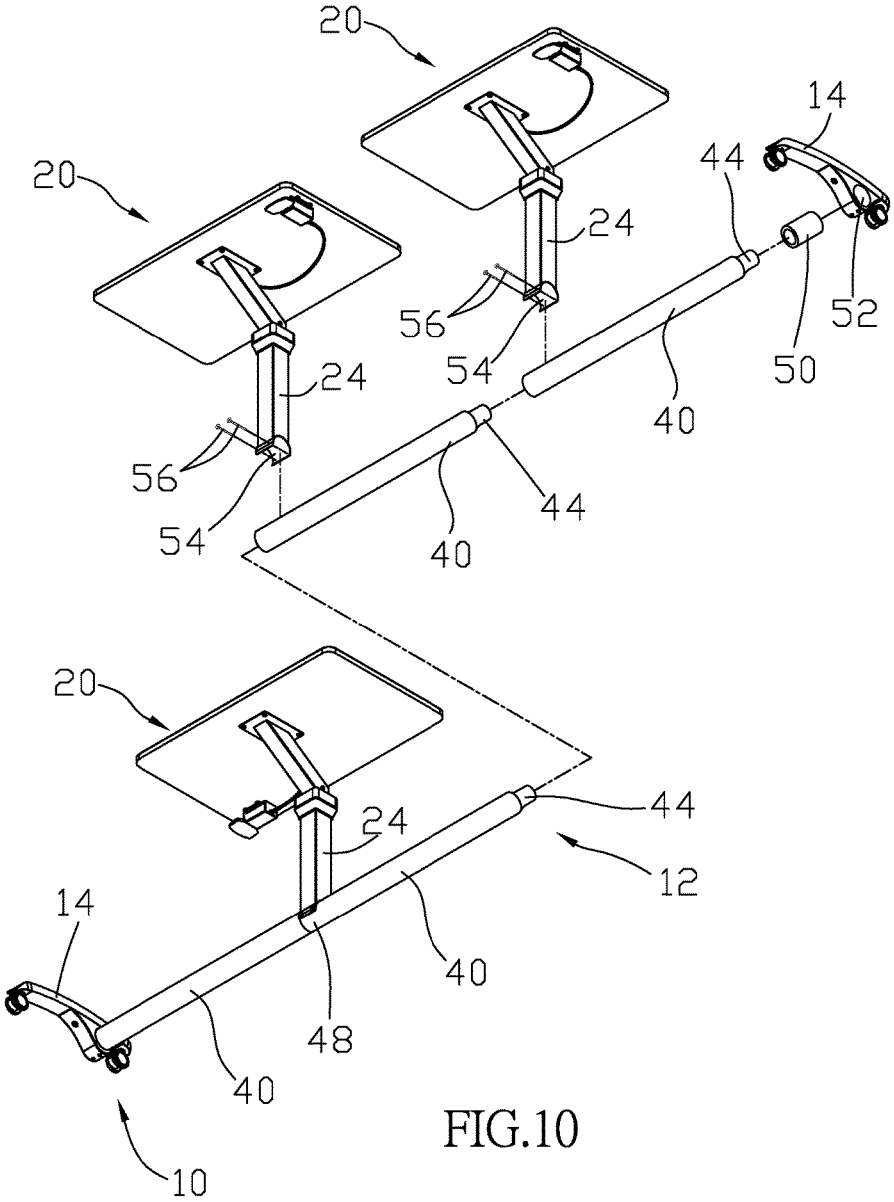
FIG. 10 is an exploded view of a sixth preferred embodiment of the present invention.

As shown in FIG. 10, a desk of the sixth preferred embodiment of the present invention includes a base 10 and three work surface assemblies 20. The work surface assemblies 20 are the same as the above embodiments, so we do not describe the detail here. The base 10 includes a shaft 12 and two stands 14 connected to opposite ends of the shaft 12. The different part of the base 10 is that the shaft 12 has a plurality of shaft sections 40 and a sleeve member 50 connected in series.

Figure 11:
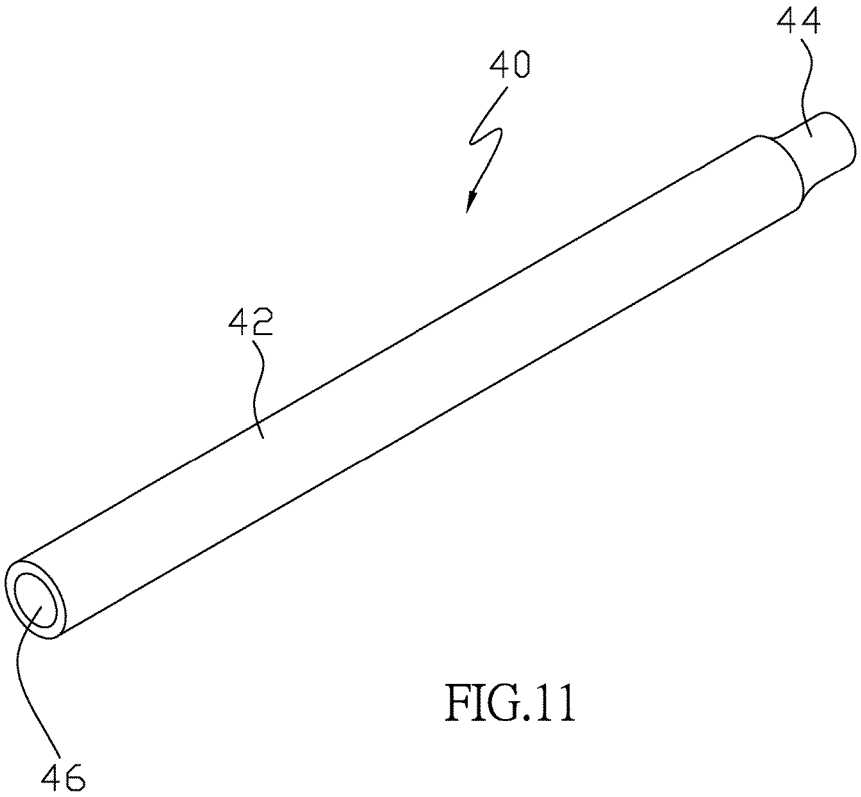
FIG. 11 is a perspective view of the shaft section of the sixth preferred embodiment of the present invention.

As shown in FIG. 11, each of the shaft sections 40 has a main body 42, a protrusion 44 at an end of the main body 42, and a slot 46 at an opposite end of the main body 42. Precisely, the protrusion 44 is a shrunk portion of the main body 42, having an outer diameter smaller than an outer diameter of the main body 42 and a diameter of the slot 46. As a result, the protrusion 44 of the shaft section 40 is able to be inserted into the slot 46 of another shaft section 40 to connect the shaft sections 40 in series to form the shaft 12. It is noted that an overlapped portion 48 is defined at a portion of the protrusion 44 engaging the slot 46 of two connected shaft sections 40.

The sleeve member 50 is a ring-like member, having a hole at a center thereof. The sleeve member 50 has an outer diameter equal to the outer diameter of the main body 42 and an inner diameter slightly greater than outer diameter of protrusion. The sleeve member 50 is fitted to the protrusion 44 of the shaft sections 40, which is not inserted into the slot 46 of another shaft section 40. As a result, the shaft 12 has a constant outer diameter.

Figure 12:
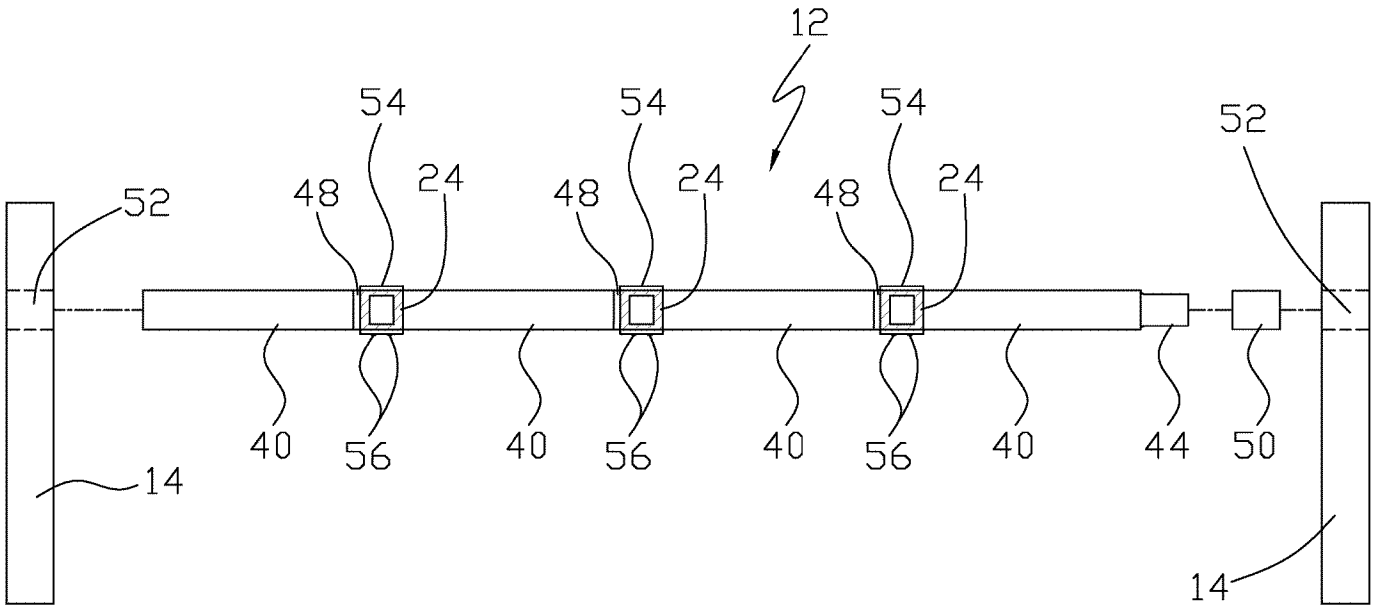
FIG. 12 is a perspective view of the shaft section of the sixth preferred embodiment of the present invention.

As shown in FIG. 12, each of the stands 14 has a bore 52, and opposite ends of the shaft 12 are received in the bores 52 of the stands 14 respectively. Precisely, the sleeve member 50 is received in the bore 52 of the stand 14. Because of the sleeve member 50, the entire shaft 12 has a constant outer diameter, so that the bores 52 of the stands 14 have the same diameters. Besides, connecting plates 54, which are fixed to the legs 24 of the work surface assemblies 20, are connected to the overlapped portions 48 of the shaft sections 40. Fasteners 56, such as bolts or screws, are provided to secure the connecting plate 54 to the main body 42 and the protrusion 44 of the connected shaft sections 40 in the overlapped portion 48.

In conclusion, the user may connect the shaft sections 40 to obtain the shaft with a predetermined length according to the number and pattern of the work surface assemblies 20. For example, it needs three shaft sections 40 for the desk of the first preferred embodiment (FIG. 1), four shaft sections 40 are needed for the desk of the second preferred embodiment (FIG. 2), three shaft sections 40 are needed for the desk of the third preferred embodiment (FIG. 3), and four shaft sections 40 are needed for the desk of the fourth preferred embodiment (FIG. 4).

It must be pointed out that the embodiments described above are only some preferred embodiments of the present invention. All equivalent structures which employ the concepts disclosed in this specification and the appended claims should fall within the scope of the present invention.

What is claimed is:

1. A desk, comprising:

a base having a shaft and two stands connected to opposite ends of the shaft; and a plurality of work surface assemblies mounted on the base, wherein each of the work surface assemblies has a board and a leg having opposite ends connected to the board and the shaft of the base respectively;

wherein the shaft has a plurality of shaft sections removably connected in series; each of the shaft sections has a main body, a protrusion at an end of the main body, and a slot at an opposite end of the main body; a diameter of the slot is greater than an outer diameter of the protrusion, whereby the protrusion of the shaft section is able to be inserted into the slot of another one of the shaft sections to connect the shaft sections in series.

2. The desk of claim 1, wherein the shaft further has a sleeve member; the sleeve member has a hole to be fitted to the protrusion of the shaft section which is not inserted into the slot of the another one of the shaft sections.

3. The desk of claim 2, wherein an outer diameter of the sleeve member is substantially the same as an outer diameter of the main body of the shaft section.

4. The desk of claim 2, wherein the each of the stands has a bore; the opposite ends of the shaft are received in the bores of the stands respectively; and the sleeve member is received in the bore of one of the stands.

5. The desk of claim 1, wherein an overlapped portion is formed at a portion of the shaft where the protrusion of the shaft section is inserted into the slot of another one of the shaft sections, and the leg of the work surface assembly is connected to the overlapped portion.

6. The desk of claim 5, wherein the leg is provided with a connecting plate, and the connecting plate is fixed to the overlapped portion of the shaft.

7. The desk of claim 6, further comprising a fastener securing the connecting plate to the main body and the protrusion at the overlapped portion.

* * * * *